US012123646B2

(12) United States Patent
Howard

(10) Patent No.: US 12,123,646 B2
(45) Date of Patent: Oct. 22, 2024

(54) SYSTEM AND METHOD TO PRODUCE LIQUEFIED NATURAL GAS USING A THREE PINION INTEGRAL GEAR MACHINE

(71) Applicant: Henry Edward Howard, Grand Island, NY (US)

(72) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 60 days.

(21) Appl. No.: 17/716,065

(22) Filed: Apr. 8, 2022

(65) Prior Publication Data

US 2022/0333853 A1 Oct. 20, 2022

Related U.S. Application Data

(60) Provisional application No. 63/175,616, filed on Apr. 16, 2021.

(51) Int. Cl.
*F25J 1/02* (2006.01)
*F25J 1/00* (2006.01)

(52) U.S. Cl.
CPC ..... *F25J 1/0022* (2013.01); *F25J 1/005* (2013.01); *F25J 1/0294* (2013.01); (Continued)

(58) Field of Classification Search
CPC ..... F25J 1/0288; F25J 1/0285; F25J 1/029; F25J 1/0208; F25J 1/0022; F25J 2230/20; F25J 2230/0205; F25J 2230/0204
See application file for complete search history.

(56) References Cited

U.S. PATENT DOCUMENTS 5,271,215 A 12/1993 Guillet
5,768,912 A 6/1998 Dubar
(Continued)

FOREIGN PATENT DOCUMENTS

EP 2336677 A1 6/2011
EP 3637029 A1 4/2020
(Continued)

OTHER PUBLICATIONS

Kenneth E. Nichols; "How to Select Turbo Machinery for your Application"; Barber Nichols, 6325 West 55th Avenue, Arvada, CO 80002, pp. 1-10.

*Primary Examiner* — Brian M King
(74) *Attorney, Agent, or Firm* — Robert J. Hampsch

(57) ABSTRACT

A system and method for liquefaction of natural gas using two distinct refrigeration circuits having compositionally different working fluids and operating at different temperature levels is provided. The turbomachinery associated with the liquefaction system are driven by a single three-pinion or four-pinion integral gear machine with customized pairing arrangements. The system and method of natural gas liquefaction further includes the conditioning of a lower pressure natural gas containing feed stream to produce a purified, compressed natural gas stream at a pressure equal to or above the critical pressure of natural gas and substantially free of heavy hydrocarbons to be liquefied.

6 Claims, 7 Drawing Sheets

(52) U.S. Cl.
CPC ..... *F25J 2210/60* (2013.01); *F25J 2210/66* (2013.01); *F25J 2215/60* (2013.01); *F25J 2230/20* (2013.01); *F25J 2230/24* (2013.01)

(56) References Cited

U.S. PATENT DOCUMENTS

| | | | | |
|---|---|---|---|---|
| 6,006,545 | A | 12/1999 | Trainer | |
| 6,412,302 | B1 | 7/2002 | Foglietta | |
| 6,484,533 | B1 * | 11/2002 | Allam | F04D 25/163 62/646 |
| 2007/0271938 | A1 | 11/2007 | Shaffer | |
| 2009/0217701 | A1 | 9/2009 | Minta | |
| 2009/0232663 | A1 | 9/2009 | Mirsky et al. | |
| 2010/0031700 | A1 | 2/2010 | Wilkinson | |
| 2010/0107684 | A1 | 5/2010 | Minta | |
| 2010/0126214 | A1 | 5/2010 | Paradowski et al. | |
| 2010/0154470 | A1 | 6/2010 | Nilsen | |
| 2011/0203312 | A1 * | 8/2011 | Jakobsen | F25J 1/0298 62/613 |
| 2011/0209496 | A1 * | 9/2011 | Horlyk | F25J 1/0289 62/613 |
| 2013/0074511 | A1 | 3/2013 | Tanaeva | |
| 2014/0245780 | A1 | 9/2014 | Wyllie et al. | |
| 2014/0305160 | A1 | 10/2014 | Chong | |
| 2014/0352353 | A1 | 12/2014 | Wissolik | |
| 2015/0211539 | A1 | 7/2015 | Wang | |
| 2017/0038136 | A1 | 2/2017 | Turney et al. | |
| 2017/0356687 | A1 | 12/2017 | Matsubara | |
| 2018/0363976 | A1 | 12/2018 | Nagao | |
| 2019/0120548 | A1 | 4/2019 | Pierre, Jr. et al. | |
| 2019/0310013 | A1 * | 10/2019 | Zielinski | F25J 1/0022 |
| 2021/0048243 | A1 | 2/2021 | Irisawa | |
| 2021/0088275 | A1 | 3/2021 | Liu et al. | |

FOREIGN PATENT DOCUMENTS

| | | | |
|---|---|---|---|
| FR | 2957140 | A1 | 9/2011 |
| FR | 3053770 | A1 | 1/2018 |
| GB | 2479940 | A | 11/2011 |
| KR | 20160147377 | A | 12/2016 |
| RU | 2656068 | | 6/2018 |
| WO | 2010/036121 | A2 | 4/2010 |
| WO | 2013/057314 | A2 | 4/2013 |
| WO | 2014/039008 | A1 | 3/2014 |
| WO | 2016151636 | A1 | 9/2016 |
| WO | 2019/008107 | A1 | 1/2019 |

* cited by examiner

SYSTEM AND METHOD TO PRODUCE LIQUEFIED NATURAL GAS USING A THREE PINION INTEGRAL GEAR MACHINE

CROSS REFERENCE TO RELATED APPLICATIONS

This application claims the benefit of and priority to U.S. provisional patent application Ser. No. 63/175,616 filed Apr. 16, 2021, the disclosure of which is incorporated by reference.

TECHNICAL FIELD

The present invention relates to production of liquefied natural gas (LNG), and more particularly, to a small or mid-scale liquefied natural gas production system that employs at least two distinct refrigeration cycles with a single integral gear machine.

BACKGROUND

Demand for both liquified natural gas production and liquified natural gas use applications within the energy, transportation, heating, power generation and utility sectors is rapidly increasing. The use of liquified natural gas as a lower cost, alternative fuel also allows for a potential reduction in carbon emissions and other harmful emissions such as nitrogen oxides (NOx), sulphur oxides (SOx), and particulate matter which are generally recognized as detrimental to air quality.

In areas where there is little to no access to natural gas pipeline distribution networks, a trend has emerged for small-scale or mid-scale liquified natural gas production which involves construction and operation of lower capacity liquified natural gas production systems built in regions where attractive sources of low cost natural gas or methane biogas are available and where there is a current demand for liquified natural gas or the demand is expected to grow over time. With such small-scale liquified natural gas production, stranded gas resource owners can monetize their natural gas assets which could not be connected to a natural gas pipeline network.

Small-scale to mid-scale liquified natural gas opportunities include various energy applications such as oil well seeding or boil-off gas re-liquefaction, integrated $CO_2$ extraction and natural gas liquefaction, utility sector applications such as peak-shaving or emergency reserves, liquified natural gas supply at compressed natural gas filling stations, and transportation applications including marine transportation applications, off-road transportation applications, and even on-road fleet transportation uses. Other small-scale or mid-scale liquified natural gas opportunities might include liquified natural gas production from biogas sources such as landfills, farms, industrial/municipal waste and wastewater operations.

Most conventional small-scale or mid-scale liquified natural gas production systems target a production of between 100 mtpd and 500 mtpd of liquified natural gas (e.g. small-scale plants) and higher, up to about 5000 mtpd of liquified natural gas for mid-scale plant operations. Many of these liquefaction systems employ mechanical refrigeration or a nitrogen-based gas expansion refrigeration cycle to cool to the natural gas feed to subzero temperatures required for natural gas liquefaction. Use of a nitrogen-based gas expansion refrigeration cycle is quickly becoming preferred technology due to its simplicity, safety and ease of operation and maintenance as well as good turn-down characteristics.

A generic example of a conventional natural gas liquefaction system employing nitrogen-based gas expansion refrigeration cycle with dual expansion is schematically shown in FIGS. 1A and 1B. Such systems have been in use for many years and are well known in the art. For example, Air Products and Chemicals, Inc. offers multiple variants of liquefaction systems including: a single expander and dual expander nitrogen recycle liquefaction system (AP-N™); a single mixed refrigerant liquefaction systems (AP-SMR™); and a methane expander based liquefaction systems (AP-C1™). Another natural gas liquefaction system that discloses a three turbine natural gas liquefaction cycle is disclosed in U.S. Pat. No. 5,768,912 (Dubar), specifically employs three booster loaded nitrogen expanders disposed in series.

While the overall production and use of liquified natural gas is increasing and the need for small-scale or mid-scale liquified natural gas plants is continuing to rise, it is the efficiencies of the conventional liquefaction systems and cycles that is less than ideal resulting in increased operating costs. When designing natural gas liquefaction cycles and liquefaction systems, trade-offs between capital costs and operational efficiencies must often be made. Such decisions are highly dependent on site-specific variables, including quality of the natural gas containing feed as well as the intended applications and transport of the liquified natural gas product.

What is needed, therefore are improvements in the design philosophy and overall performance of such natural gas liquefaction processes and systems with the objective of minimizing the heat exchange liquefaction inefficiencies and power consumption while facilitating turbo-machinery design. This goal of minimizing the heat exchange liquefaction inefficiencies is critical to achieving meaningful performance improvements.

SUMMARY OF THE INVENTION

Features and advantages of the present system and method to produce liquefied natural gas include: (i) a liquefaction cycle that uses two distinct refrigeration circuits having compositionally different working fluids operating at different temperature levels; (ii) conditioning of the natural gas containing feed to produce purified, compressed natural gas stream at a pressure equal to or above the critical pressure of natural gas and substantially free of heavy hydrocarbons and other impurities; and (iii) use of a mixed service integral gear machine having at least three pinions and configured for driving the one or more recycle compression stages of the refrigeration circuits while also receiving work produced by one or more high efficiency radial inflow turbines of the refrigeration circuits, with the pairings of turbomachinery on the different pinions optimized to reduce or minimize the heat exchange liquefaction inefficiencies to improve the production capacity of the small-scale or mid-scale system while reducing the unit power consumption for liquefied natural gas production.

BRIEF DESCRIPTION OF THE DRAWINGS

It is believed that the claimed invention will be better understood when taken in connection with the accompanying drawings in which:

DETAILED DESCRIPTION

Figure 1A:
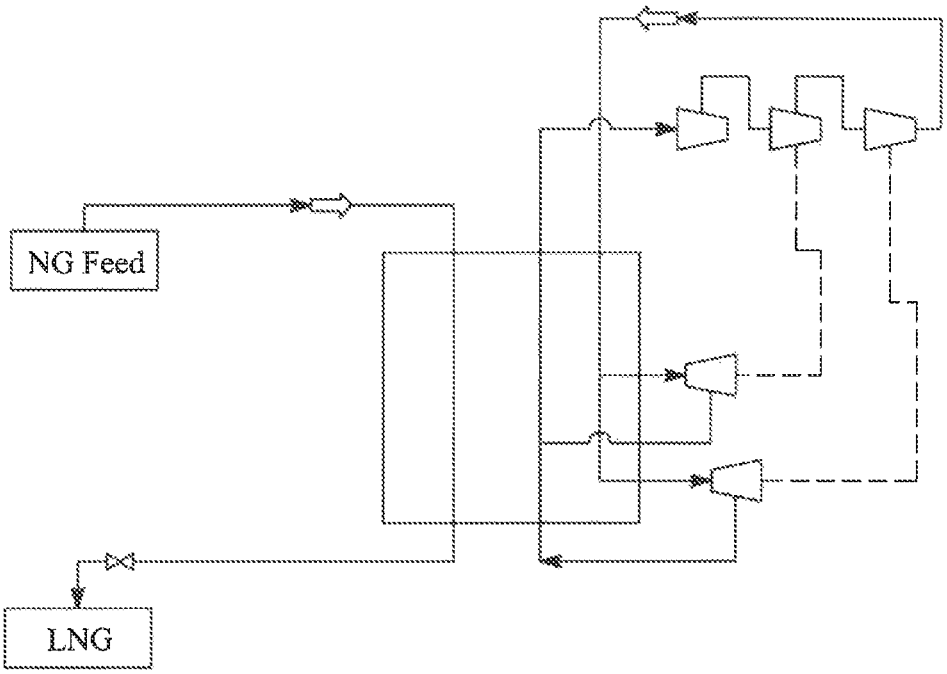
FIG. 1A shows a generalized schematic of the process flow diagram for a conventional natural gas liquefaction process known in the prior art.

The design of high efficiency liquefaction processes is the result of a simultaneous considerations of heat transfer and turbomachinery. The minimization of heat transfer irreversibility is achieved when the divergence of the warming and cooling composite curves (e.g. energy vs temperature) is minimized. Process definition of flows, pressures and temperatures largely control the resulting composite curves. Turbomachinery efficiency is maximized when the head and flow characteristics of the process are consistent with experience-based optimums. These optimal designs are often characterized by established ratios of geometry, flow and head (Ns, Ds). Such considerations resulting from dimensional similarity are well known to the art of gas processing. See, for example, the publication entitled 'How to Select Turbomachinery for your Application' by Kenneth E. Nichols. These optimal turbomachinery conditions are a function of the type of machine under consideration.

In the present system and method, the use of centrifugal turbomachines, and in particular several radial inflow turbines, find particular application. Satisfying the characterizing dimensionless ratios is critical to maximizing turbine and compressor efficiency. The subject invention addresses the issue of accomplishing both of these objectives simultaneously. The introduction of a second working fluid normally would require a separate expansion-compression train. For modest scale liquefied natural gas production, the capital expense of such additional machinery is prohibitive. The integration of a second working fluid into a single common integral gear compression system or machine presents numerous challenges. In addition to those highlighted above, the work imparted to any particular pinion of such a machine is often limited to about 35% to 50% of the total power draw.

As indicated above, one of the distinct features of the present system and method to produce liquefied natural gas is that the liquefaction cycle that uses two distinct refrigeration circuits having compositionally different working fluids operating at different temperature levels. Details of this feature and the advantages it provides are discussed later in this application.

Another of the advancements disclosed herein is the conditioning of the natural gas containing feed to produce purified, compressed natural gas stream at a pressure equal to or above the critical pressure of natural gas and substantially free of heavy hydrocarbons and other impurities. Specifically, a conditioning circuit is employed that receives a natural gas containing feed stream, such as natural gas derived from a biogas source, and produces a purified, compressed natural gas stream at a pressure equal to or above the critical pressure of natural gas. The preferred conditioning circuit includes a natural gas compression stage and optionally a phase separator and/or scrubbing column configured to remove impurities such as heavy hydrocarbons from the natural gas feed stream. The scrubbing column may employ bypass vapor feed or indirect heating as a means of generating stripping vapor. Indirect heating may be accomplished by cooling any one of the warm constituent fluids (e.g. compressed nitrogen or natural gas). In addition, water and carbon dioxide may be also removed within the conditioning circuit, preferably upstream of the phase separator or scrubbing column through the use of an adsorbent-based temperature swing adsorption (TSA) unit. For example, to remove the heavy hydrocarbons, the natural gas feed stream may be cooled and then directed to a scrubbing column or phase separator configured to strip out impurities and produce an overhead stream of purified natural gas vapor and an impure bottoms liquid stream. The overhead stream of purified natural gas vapor is then directed to a natural gas compression stage.

The present system and method details an approach where the natural gas feed stream is first pretreated by way of partial condensation, phase separation and/or rectification (i.e. scrubbing) before the natural gas feed stream is compressed. Such pre-treatment operations naturally must be conducted at conditions that are substantially removed from the critical point of the natural gas mixture. In general, direct phase separation becomes impractical at pressures greater than about 75% of critical pressure. This fact creates a heat transfer inefficiency in conventional natural gas liquefaction plants. The subsequent and direct liquefaction of a sub-critical gas stream results in a composite curve divergence near the dewpoint of the mixture. Furthermore, the lower pressure of liquefaction generally results in a colder level of warm turbine operation. The colder operation of the primary refrigeration turbine creates a meaningful penalty in terms of unit power consumption.

Yet another advantageous feature of the present system and method to produce liquefied natural gas is the use of a mixed service integral gear machine having at least three pinions and configured for driving the one or more recycle compression stages of the refrigeration circuits while also receiving work produced by at least one of the one or more high efficiency radial inflow turbines of the refrigeration circuits. An important aspect of this advantageous feature relates to the pairings of turbomachinery on the different pinions in a manner that optimizes the performance of the present system and method.

The optimization of the turbomachinery starts with a consideration of turbine efficiency. Any given process definition (e.g. Pressures, Temperatures, and Flows) that results in a feasible heat transfer (liquefaction) design also provides the necessary input, such as flow and head characteristics, that are necessary to define the non-dimensional characteristics (Ns, Ds) required to specify component turbine rotational speed and diameter. It is well established that radial inflow turbines reach peak efficiency with U/Co (i.e. Rotor Tip Speed/Isentropic Spouting Velocity) values near 0.70. This ratio is also defined by the following equation [U/Co]=[NsDs]/154. As such, effective process definition will dictate the speed and diameter necessary for the turbine to operate at peak efficiency. In the context of the present invention, this optimal turbine speed is then applied to the association compression stage. In general, optimal centrifugal compression stage efficiency can be attained for specific speed (Ns) values ranging from about 80 to about 130. With respect to gas compression, process definition dictates compression stage head and the associated turbine on the same pinion dictates rotational speed which in turn results in a specific speed. The above calculation form one part of the overall process optimization. More specifically, the optimization is an iterative process involving process definition, turbomachine pairing based upon the above calculation and finally a consideration of the integral gear machine pinion power and overall input power limitations.

A conventional two-turbine nitrogen expansion-based liquefier can follow a more or less sequential design approach. In contrast, the present system and method was developed by approaching this problem from the standpoint that high efficiency liquefaction must be maintained (i.e. the process definition minimizes heat transfer irreversibility). The use of a mixed service integral gear 'bridge' machine servicing dual refrigeration circuits, each having gas compression stages and gas expansion is critical to that end. The turbomachinery is then defined so as to satisfy the conditions for optimal turbine performance (outlined above) as well as the constraints imparted by the need to consolidate compression-expansion service into a single integral gear 'bridge' machine. The hardware constraints and limitations of the bridge machine are typically a function of bull gear and primary driver size. In general, the 'bridge' machine drivers pertinent for the present system and method spans the range of about 4 MW to 20 MW with associated maximum pinion speeds in the range of 20,000 to 50,000 rpm. Furthermore, the maximum power imparted to any given pinion or any given turbine-compression stage pairing is generally limited to less than 50% and in some cases to about 35% (of the total bridge machine driver power).

Conventional small-scale and medium-scale liquified natural gas plants (i.e. <1000 mtpd) that use a nitrogen-based gas expansion as the primary source of refrigeration typically employ centrifugal recycle compression stages for the refrigerant that are typically driven by a single service integral gear 'bridge' machine contained within a common housing that includes a large diameter bull gear with several meshing pinions upon the ends of which the various compression impellers are mounted forming the plurality of refrigerant compression stages. The pinions may have differing diameters to best match the speed requirements of the coupled compression impellers. Each of the multiple compression impellers and radial turbines are typically contained within their own respective housings and collectively provide several stages of recycle compression, as desired.

Linde Inc. has also developed a portfolio of integral gear machines combining compression stages and high efficiency radial inflow expanders on a single machine having up to four pinions in what is referred to as an integral gear 'bridge' machine. Linde's bridge machines are conventionally used in hydrogen/syngas plants as well as air separation plants and typically come in different frame sizes. The Linde 'bridge' machines can be used to operatively couple a plurality of radially inflow turbines and centrifugal compression stages. The Linde 'bridge' machines come fully packaged or integrated with appropriate PLC controllers, control valves, safety valves, intercoolers, aftercoolers, oil system, etc.

Modification of the conventional single service integral gear compression machines or the Linde 'bridge' machine to handle mixed gas service could involve additional capital costs estimated to be about 5% to 10% of the total machine. The additional capital costs would be targeted for retrofitting the machine controls and provide dry gas sealing for the natural gas service. However, these additional capital costs are more than offset by the improvement in liquefaction efficiency and the unit power cost reduction of the liquefaction process.

The closest prior art reference disclosing a liquefaction cycle that uses both natural gas and a nitrogen-based refrigerant as the two distinct refrigeration circuits having compositionally different working fluids operating at different temperature levels is U.S. Pat. No. 6,412,302 issued in the name of Foglietta. One of the key differences between the Foglietta reference and the present system and method is that the disclosed Foglietta system and process requires at least two stages of natural gas recompression (i.e. centrifugal compression) to achieve the disclosed compression ratio of 2.5 to 7.0, which could require a minimum of two or perhaps three pinions on the integral gear machine to service the natural gas. Similarly, the nitrogen expander in the disclosed Foglietta system and process also requires at least two stages of nitrogen compression requiring two additional pinions, for a minimum of four pinions on the integral gear machine in the disclosed Foglietta system. The process and would likely require use of a larger frame bull gear.

The Foglietta reference also discloses a closed loop hydrocarbon based refrigerant circuit. With the methane in the refrigeration loop, the expander exhausts at about 200 psia and −119° F. and subsequently compressed in at least two or more stages of recompression up to 1400 psia. In contrast, the natural gas feed in Foglietta is delivered to the heat exchanger at about 900 psia, which admittedly is above the critical pressure but would require either a different machine to drive the compression stages of the natural gas feed or yet additional pinions on the single mixed service machine. Unlike, the present system and method, there is no disclosure of any integration of the conditioning circuit to remove the heavy hydrocarbons from the natural gas feed stream, nor is the feed split into a first portion to be liquefied and a second portion to be directed to the refrigeration circuit. In short, the Foglietta reference simply does not disclose, suggest or even contemplate a mixed service integral gear machine.

LNG Production with 3-Pinion and 3 Turbine Integral Gear Machine

Figure 2A:
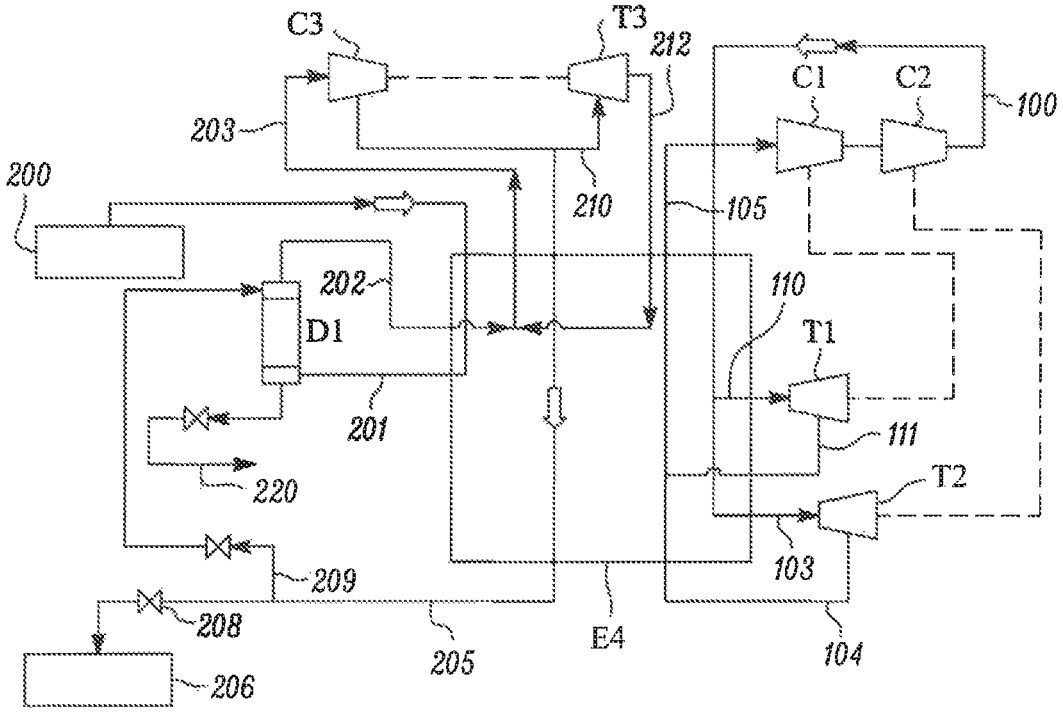
FIG. 2A shows a schematic of the process flow diagram for the present system and method for liquefied natural gas production using two distinct refrigeration circuits and an integral gear machine with three pinions and three turbines.
Figure 3B:
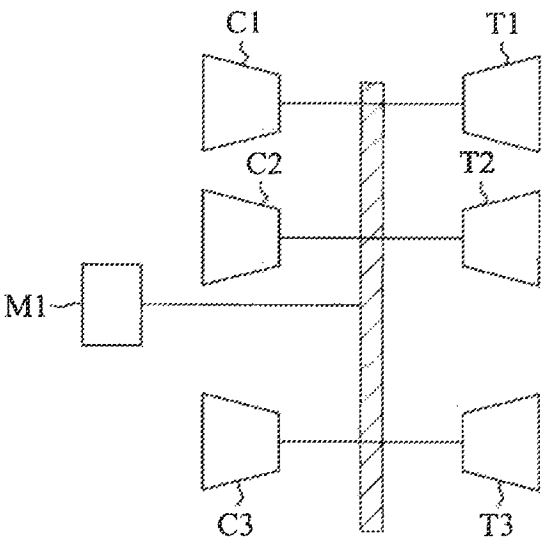
FIG. 3B shows a schematic illustration of the integral gear machine with three pinions of FIG. 3A depicting the optimized pairing of turbomachines.
Figure 3A:
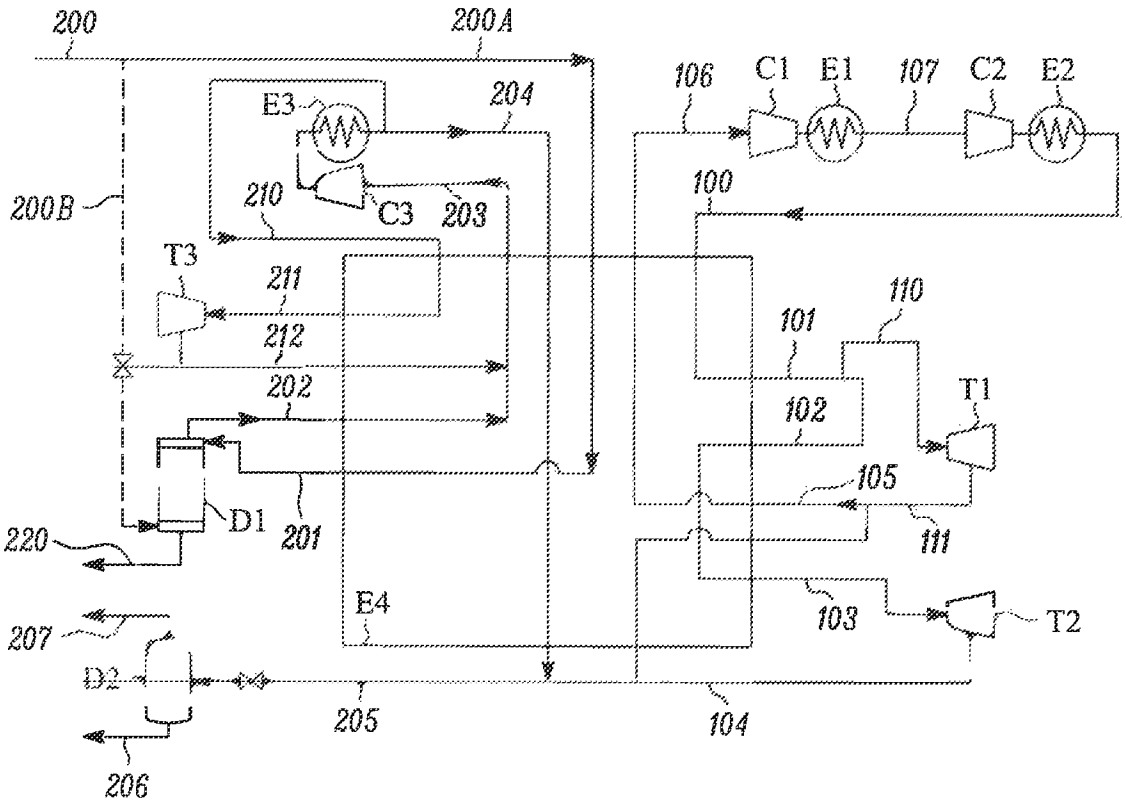
FIG. 3A shows a more detailed schematic of the process flow diagram for an alternate embodiment of the present system and method for liquefied natural gas production using two distinct refrigeration circuits and a smaller frame integral gear machine with three pinions and including three turbines.

Turning to FIGS. 2A and 3A, schematics of the high-level process flow diagram for similar embodiments of the present system and method for liquefied natural gas production using two distinct refrigeration circuits and an integral gear machine are shown. As seen therein, a natural gas vapor feed 200, at a nominal feed pressure of between about 20 bar(a) and 40 bar(a), and by way of example at a pressure of about 34 bar(a), is received and thereafter conditioned in a conditioning circuit to remove the heavy hydrocarbons and other impurities from the feed stream and pressurize the purified natural gas containing stream to a pressure equal to or above the critical pressure of natural gas.

As seen in the figures, the conditioning circuit preferably includes partial cooling of the natural gas feed 200A in the heat exchanger E4 and then purifying the cooled natural gas feed 201 and/or natural gas vapor stream 200B in a scrubbing column D1 to remove the heavy hydrocarbons and other impurities from the natural gas feed stream. An overhead vapor stream 202 of purified natural gas exits the top of the scrubbing column D1 while a liquid bottoms stream 220 containing the heavy hydrocarbons and impurities is removed from the column. Alternatively, the conditioning circuit may use a phase separator or both a phase separator and a scrubbing column to strip out the heavy hydrocarbons and other impurities from the natural gas feed stream. In addition, although not shown, the purification of the natural gas feed stream may also include removal of water and carbon dioxide via purification techniques well known in the art, such additional purification techniques preferably conducted upstream of the scrubbing column. The purification techniques may include solvent based absorption systems, adsorptive purification as well as adsorptive gettering.

The purified natural gas vapor stream 202 is directed to a natural gas compression stage C3 operatively coupled to the integral gear machine (see FIG. 2B), preferably a Linde-type 'bridge' machine, where it is further compressed to a pressure equal to or above the critical pressure of natural gas, or above 46 bar(a). In the presently illustrated systems, the purified natural gas containing stream is further compressed to a pressure preferably between about 50 bar(a) and 80 bar(a), and more preferably to a pressure between about 60 bar(a) and 75 bar(a) and then cooled in aftercooler E3.

A first portion of the purified, further compressed super-critical natural gas stream 204 is directed to the cooling passages in the heat exchanger(s) E4 where it is liquefied and subcooled via indirect heat exchange with two or more different refrigerant streams traversing the warming passages of the heat exchanger(s) E4. A second portion of the purified, further compressed super-critical natural gas stream 210 is partially cooled in heat exchanger E4 and the partially cooled stream 211 is then expanded in a natural gas expander T3 to produce a natural gas exhaust stream 212 having a pressure less than or equal to the pressure of the natural gas feed stream 200. Preferable, the flow of second portion of the purified, compressed natural gas stream 210 is at least 2.0 times greater, and more preferably greater than 2.5 times greater, than the flow of first portion of the purified, compressed natural gas stream 204. After expansion, the natural gas exhaust stream 212 is directed to heat exchanger(s) E4 to cool the first portion of the purified, compressed natural gas stream 204 or other natural gas streams and is then recycled back to the natural gas compression stage together with the purified natural gas stream 202 as recycle stream 203.

The natural gas expander T3 is preferably a high speed, high efficiency radial inflow turbo-expander operatively coupled to the integral gear machine and configured with an expansion ratio approximately equal to or comparable to a compression ratio of the natural gas compression stage C3, which is typically below about 3.0. In the embodiment shown in FIGS. 3A and 3B, the high speed, high efficiency radial inflow turbo-expander is also operatively coupled to the same pinion of the integral gear machine as the natural gas compression stage. Exactly what constitutes a high-speed expander very much depends on the size and capacity of the integral gear machine. For example, one skilled in the art would characterize a natural gas expander configured to operate at about 50,000 rpm when associated with a small integral gear machine frame (2~4 MW of absorbed power) as high speed whereas a natural gas expander configured to operate at about 30,000 rpm would be considered a high speed expander if associated with a large integral gear machine frame.

As indicated above, the first portion of the purified, further compressed super-critical natural gas stream 204 is cooled within the heat exchanger(s) E4 via indirect heat exchange against the combined recycle stream 202, 212, 203 as well as a primary nitrogen-based refrigerant streams 104, 105 and yields a subcooled liquified natural gas stream 205. A portion of the subcooled liquified natural gas stream 209 may optionally be directed as a reflux stream to the scrubbing column as depicted in FIGS. 2A, 4A, and 5A. The remaining portion of subcooled liquified natural gas stream or the entire subcooled liquified natural gas stream is thereafter reduced in pressure via a valve 208 or a liquid turbine and phase separated in a phase separator D2 yielding a vapor stream 207 and liquid natural gas stream 206 constituting the liquefied natural gas product. It should be noted that in some instances it may be advantageous to employ a small portion of the liquefied natural gas as a recycle and reflux stream to the scrubbing column.

The primary refrigeration used in the illustrated liquefied natural gas production system that uses two distinct refrigeration circuits and an integral gear machine is preferably a nitrogen-based gas expansion refrigeration circuit. In such illustrated primary refrigeration circuit, the primary refrigerant 106, 107 is compressed in a plurality of serially arranged compression stages C1, C2 with appropriate intercooling and aftercooling by aftercoolers E1 and E2 used to remove the heat of compression. Such aftercooling may be accomplished by way of indirect contact with air, cooling water, chilled water or other refrigerating medium or combinations thereof. The compressed primary refrigerant 100 is then further cooled in the heat exchanger(s) E4 and directed to one or more turbines T1, T2 configured to expand the compressed refrigerant streams to generate refrigeration.

Specifically, the compressed primary refrigerant stream 100 is partially cooled in the heat exchanger E4 and the resulting cooled stream 101 is split. A first portion of the cooled, compressed refrigerant stream 100 is directed to a warm turbine T1 while a second portion of the cooled, compressed primary refrigerant stream 102 is further cooled in the heat exchanger E4 to produce a cold stream portion 103 which is then directed to a cold turbine T2. The cold turbine T2 is configured to expand the cold stream portion 103 of the primary refrigerant stream to produce a cold turbine exhaust stream 104 that is recycled back to the primary refrigerant compression stages as recycle stream 105 via one or more of the plurality of warming passages in the heat exchanger(s) E4. The partially cooled first portion is a warm stream portion 110 of the compressed primary refrigerant stream that exits the heat exchanger E4 at a location and temperature that is warmer than the cold portion. The warm stream portion 110 of the compressed refrigerant stream is then expanded in the warm turbine T1 to produce a warm turbine exhaust stream 111 that is also recycled to the one or more primary refrigerant compression stages as recycle stream 105, 106 via one or more of the plurality of warming passages in the heat exchanger(s). Although not preferred, the primary refrigerant streams may be warmed in independent passages and conceivably at independent pressures. The warmed primary refrigerant streams could be directed to differing introduction points in the recycle compression train. More generally, it is recognized that the design of multi-pass brazed aluminum heat exchangers are capable of processing multiple stream wherein internal redistribution point may be configured. Such an option can be employed with the subject invention. For instance, the first portion of the conditioned natural gas stream may be subjected to redistribution into increasing numbers of passages as the fluid cools. Similarly, the cold turbine exhaust stream from the primary refrigeration circuit may be extracted at an intermediary point and combined with the warm turbine exhaust stream before or after partial warming within the multi-pass heat exchanger.

Figure 2B:
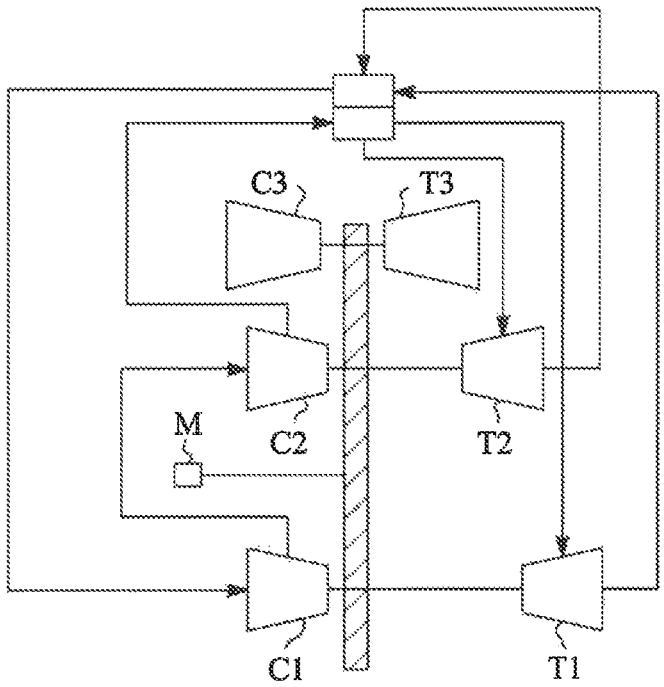
FIG. 2B shows a schematic illustration of the integral gear machine with three pinions of FIG. 2A depicting the optimized pairing of turbomachines.

Both the warm turbine T1 and the cold turbine T2 as well as the serially arranged compression stages C1 and C2 are operatively coupled to the integral gear machine (See FIGS. 2B and 3B). In particular, one of the primary refrigerant compression stages C2 and the cold turbine T2 are operatively coupled to the same pinion of the integral gear compressor machine. Likewise, the other primary refrigerant compression stage C1 and the warm turbine T1 are operatively coupled to the same pinion of the integral gear compressor machine.

Turning now to FIGS. 2B and 3B as well as Tables 1A, 1B, and 1C, embodiments of the three pinion and three turbine integral gear machine is schematically depicted in FIGS. 2B and 3B showing a bull gear driven by a motor and comprised of a plurality of compression stages and turbines. In Tables 1A, 1B, and 1C, the power consumption of the three pinion and three turbine integral gear machine has been normalized to the nominal liquefied natural gas product flow. In this example, the bull gear accommodates three pinions and is sized to deliver roughly 280 metric tonnes per day (mptd) to about 320 mptd of liquefied natural gas. The first pinion couples the bull gear to a first recycle compression stage and the warm turbine and absorbs about 35% of the input power to the integral gear machine. The second pinion operatively couples the bull gear to the second recycle compression stage and the cold turbine and absorbs about 42% of the integral gear machine power. In this configuration, the second pinion operates near the maximum fractional power for any given pinion relative to total integral gear machine absorbed power. Note that the warm turbine provides more than 4 times the power than that of the cold turbine, the warm turbine provides the largest source of refrigeration, and more particularly in this example about 4.5 times more power than the cold turbine. In this embodiment, the third pinion arrangement is dedicated to the natural gas service, namely the natural gas compression stage requiring and natural gas turbine expansion and absorbs the remaining 23% of the integral gear machine power.

Table 1B compares the simulated performance of the baseline liquefied natural gas system and process generically depicted in FIG. 1A with the three-pinion, three-turbine arrangement shown in FIGS. 2A and 3A using the above-described arrangement of the turbines and compression stages on the three pinions of the integral gear machine. As seen therein, the energy usage per metric tonne of liquefied natural gas produced is about 10 percent lower. Given the lower unit power and distributed power consumption of the three pinion design any given machine frame size will likely deliver a liquefied natural gas product flow increase of about 12% to 15%. The increased liquefied natural gas production rate resulting from the present system and method is dependent upon the maximum absorbable pinion power and the total potential power consumption of the integral gear machine.

The process and configurations detailed in FIGS. 2A, 2B, 3A and 3B can be effectively applied over a broad range of liquefied natural gas production rates by simply changing the frame size of the integral gear 'bridge' machine and relative sizes of the associated turbomachinery. In general, such a process will find utility with commercially available bull gears in a liquified natural gas production capacity range of between about 150 mtpd and about 1000 mtpd. The relative distribution of power across the three pinions will vary depending upon the pinion speed and the power limitations or constraints imposed by any particular bull gear, with the approximate normalized range of total adsorbed power for each pinion shown in Table 1C. The target pinion speed per unit of liquified natural gas mass flow will also vary to the reciprocal of liquified natural gas mass flow raised to roughly the 3/2 power.

TABLE 1A

| FIGS. 2B & 3B | Service #1 | Power (kw-hr/kg) | Service #2 | Power (kW-hr/kg) | Speed (rev/kg) | Net Power (kw-hr/kg) |
|---|---|---|---|---|---|---|
| Pinion #1 | N2 Comp #1 Cl | 0.279 | N2 Warm T1 | −0.132 | 138.1 | 0.148 |
| Pinion #2 | N2 Comp #2 C2 | 0.231 | N2 Cold T2 | −0.029 | 182.6 | 0.201 |
| Pinion #3 | NG Comp #3 C3 | 0.118 | NG Warm T3 | −0.043 | 217.1 | 0.074 |

TABLE 1B

| Embodiment | Max N2 Pressure (bara) | Min N2 Pressure (bara) | NG Feed Pressure (bara) | NG Liquefaction Pressure (bara) | IGM Power kw-hr/mt | Δ Energy Usage (%) |
|---|---|---|---|---|---|---|
| FIG. 1 | 63.0 | 10.3 | 34.0 | 39.0 | 471 | Baseline |
| FIGS. 2A, 3A | 51.5 | 12.0 | 34.0 | 69.0 | 423 | −10.2% |

TABLE 1C

| Approximate Range of Absorbed Total Pinion Power Consumption | | |
|---|---|---|
| Pinion | Minimum kw-hr/kg | Maximum kw-hr/kg |
| Pinion #1 (C1-T1) Warm Turbine | 0.10 | 0.20 |
| Pinion #2 (C2-T2) Cold Turbine | 0.15 | 0.25 |
| Pinion #3 (C3-T3) NG Warm Expander | 0.05 | 0.20 |

LNG Production with 4-Pinion and 3 Turbine Integral Gear Machine

The process flow diagram depicted in FIGS. 4A and 5A are very similar to the process flow diagrams of FIG. 3A described above and for sake of brevity, much of the descriptions of the detailed arrangements will not be repeated. Rather, the following discussion will focus on the differences in the process flow diagram depicted in FIGS. 4A and 5A when compared to the process flow diagram depicted in FIG. 3A.

In the process flow diagram of 4A, the main difference is the presence of a third compression stage C2B in the primary refrigeration circuit. This third primary refrigerant compression stage C2B is arranged in a parallel arrangement with the second primary refrigerant compression stage C2A where both the second and third primary refrigerant compression stages are disposed downstream of the first primary refrigerant compression stage C1. The third primary refrigerant compression stage C2B is also operatively coupled to the integral gear machine by a fourth pinion (see FIG. 4B). Note reference numerals 400, 400A, 400B 401, 402, 403, 404, 405, 406, 407, 410, 411, 412, and 420 in FIG. 4A generally correspond to the same streams 300, 300A, 300B, 301, 302, 303, 304, 305, 306, 307, 310, 311, 312, and 320 in FIG. 3A, respectively. Likewise, the reference numerals 450, 451, 452, 453, 454, 455, 456, 457 and 460, in FIG. 4A generally correspond to the same streams 100, 101, 102, 103, 104, 105, 106, 107 and 110, in FIG. 3A, respectively.

In the process flow diagram of 5A, the main difference is the presence of a third compression stage in the primary refrigeration circuit and a liquid turbine LT disposed downstream of the heat exchanger(s) configured to expand the subcooled, liquified natural gas stream 505 to produce stream 505B. Similar to the embodiment shown in FIG. 4A, the third primary refrigerant compression stage C2B is arranged in a parallel arrangement with the second primary refrigerant compression stage C2A where both the second and third primary refrigerant compression stages C2A and C2B are disposed downstream of the first primary refrigerant compression stage C1. The third primary refrigerant compression stage C2B is operatively coupled to the integral gear machine by means of a fourth pinion (see FIG. 5B). Note reference numerals 500, 500A, 500B 501, 502, 503, 504, 505, 506, 507, 510, 511, 512, and 520 in FIG. 5A generally correspond to the same streams 300, 300A, 300B, 301, 302, 303, 304, 305, 306, 307, 310, 311, 312, and 320 in FIG. 3A, respectively. Likewise, the reference numerals 550, 551, 552, 553, 554, 555, 556, 557 and 560, in FIG. 5A generally correspond to the same streams 100, 101, 102, 103, 104, 105, 106, 107 and 110, in FIG. 3A, respectively.

In general, the cold turbine supplies only about 10% to 20% of the total refrigeration required for the liquefaction of supercritical natural gas. In contrast, the nitrogen-based warm turbine may provide in excess of 50% of the required refrigeration. Although effective pairing of the cold turbine is possible with respect to the nitrogen-based recompression train, the associated pinion will consume a disproportionate amount of power relative to the pinion associated with the warm turbine. As a consequence, it has been found that it is the pinion associated with the cold turbine that is most likely to define or limit the capacity for a three pinion integral gear machine design. To alleviate this constraint, the power associated with the cold turbine pinion (compression stage) may be partially displaced (or shared) via an additional fourth pinion. The purpose of this additional pinion is to reduce the power consumed by the booster compression stage associated with the cold turbine. By diverting about 40% to 60% of the work toward a separate compression stage on a separate pinion (i.e. the fourth pinion), the utilization of the integral gear machine can be maximized (from the perspective of total power consumption). By fully utilizing the potential power consumption of the integral gear machine the quantity of liquefied natural gas produced from a fixed machine frame size is maximized. This is advantageous from the standpoint of capital utilization.

The degree to which the high pressure natural gas is subcooled at the cold end of the liquefaction heat exchanger will dictate the quantity of gas that is ultimately flashed off (i.e. that liquid which is converted to gas upon depressurization). A simple isenthalpic expansion via a valve is less efficient than a dense phase expander or liquid turbine. Natural gas that is not maintained as a liquid represents a loss or inefficiency of the liquefaction process. By extracting mechanical energy from the fluid, the amount of flash gas generated at a common inlet pressure and temperature will be reduced. This added refrigerating effect becomes more pronounced as the pressure of the liquefied natural gas climbs. Since enhanced compression of natural gas prior to liquefaction is one of the objectives of the subject invention, the synergy afforded to the process by way of liquid turbine is accentuated. It has been found that the unit power consumption of the process can be further reduced by about 5% through the addition of a dense phase LNG expander. As noted, the total power draw of the integral gear machine is often the limiting aspect for small-scale and mid-scale liquefied natural gas production systems. Since the introduction of a dense phase LNG expander or liquid turbine reduces the net unit power consumption, additional throughput can be achieved given the same integral gear machine frame-driver size. A further, secondary benefit of the dense phase LNG expander or liquid turbine is the capture of mechanical power generated by the dense phase expansion by way of a generator. This secondary benefit can further reduce total cycle power consumption by about 0.5% to 1.0%.

Figure 1B:
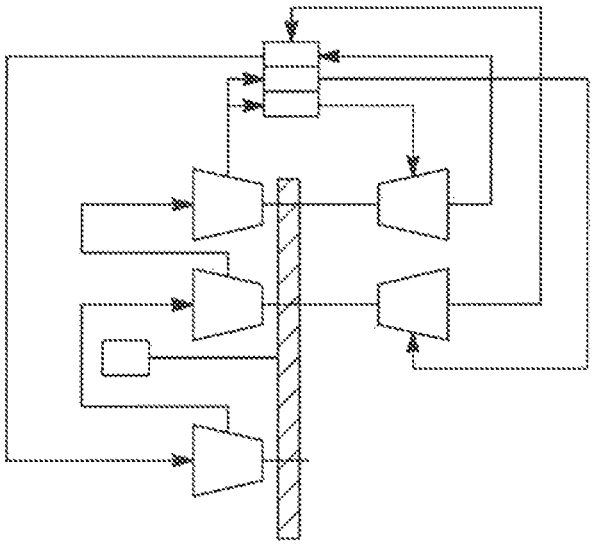
FIG. 1B shows a generalized schematic illustration of a conventional integral gear machine with three pinions and coupled to two turbines.
Figure 4B:
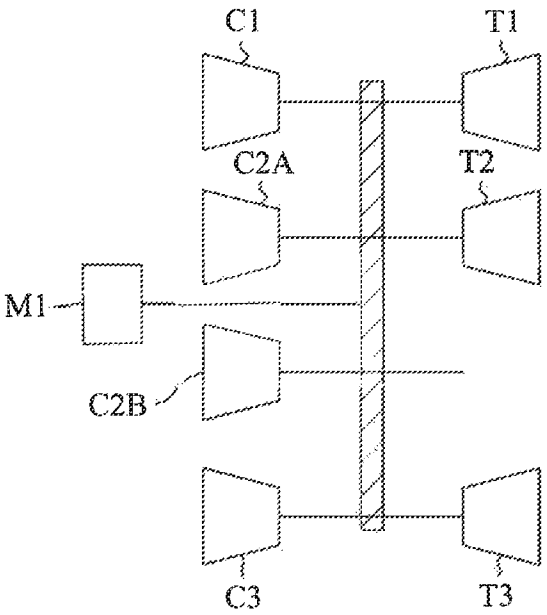
FIG. 4B shows a schematic illustration of the integral gear machine with four pinions of FIG. 4A depicting the optimized pairing of turbomachines.
Figure 4A:
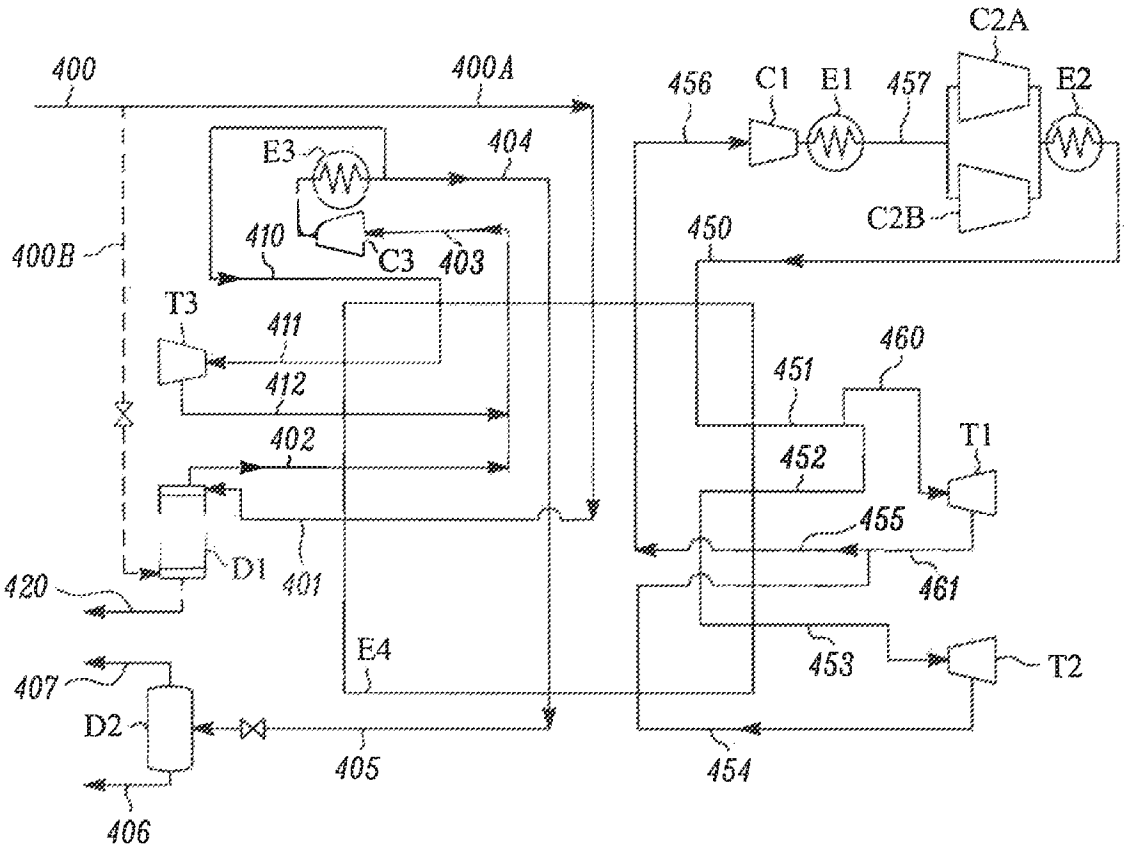
FIG. 4A shows a generalized schematic of the process flow diagram for the present system and method for liquefied natural gas production using two distinct refrigeration circuits and an integral gear machine with four pinions.
Figure 5B:
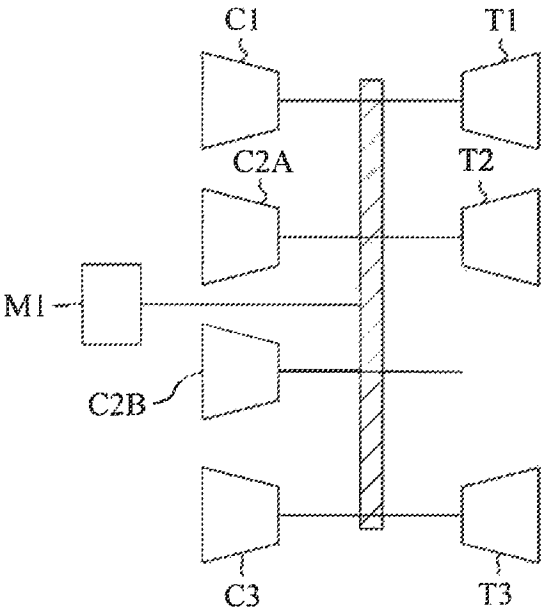
FIG. 5B shows a schematic illustration of the integral gear machine with four pinions of FIG. 5A.
Figure 5A:
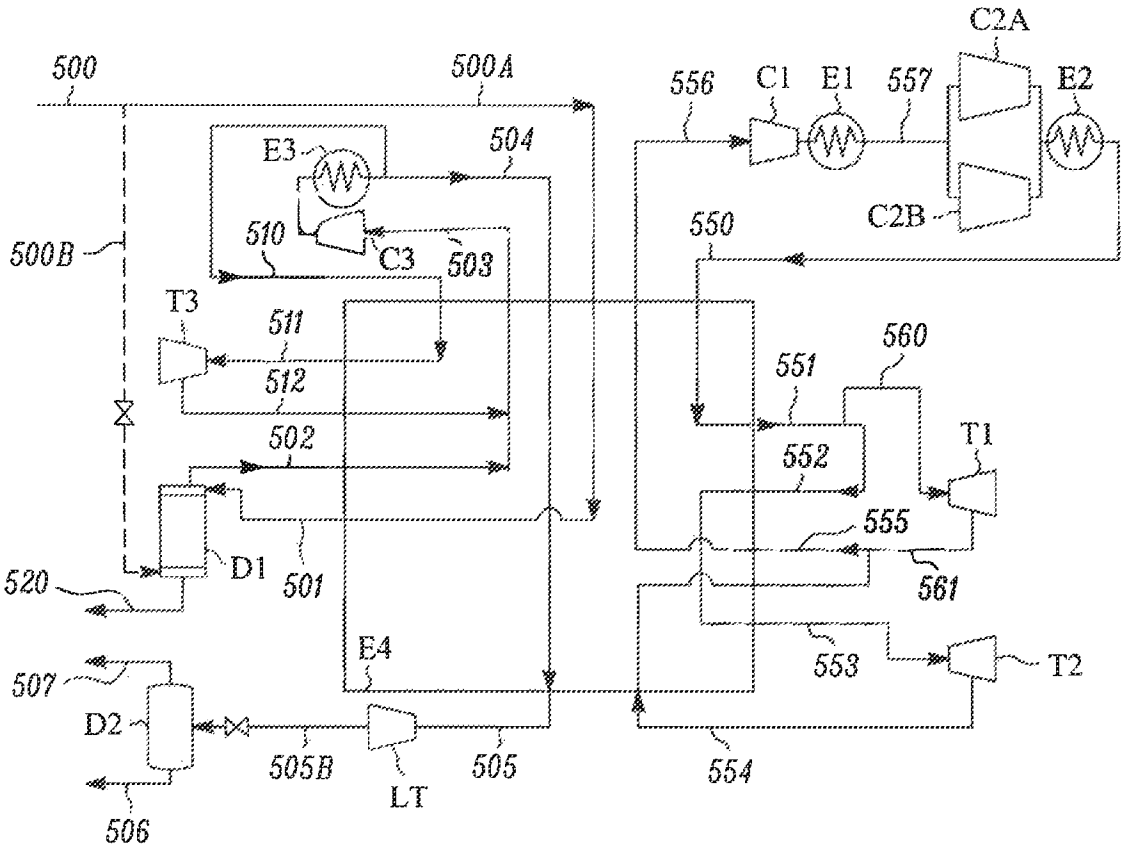
FIG. 5A shows a generalized schematic of the process flow diagram for the present system and method for liquefied natural gas production showing an alternative embodiment using two distinct refrigeration circuits and an integral gear machine with four pinions.

The embodiments of the three pinion and three turbine integral gear 'bridge' machine schematically depicted in FIGS. 4B and 5B are also compared to the baseline integral gear machine of FIG. 1B in Tables 2A, 2B, and 2C. As with Tables 1A, 1B, and 1C, the power consumption and speed values in Tables 2A, 2B, and 2C, have been normalized to the nominal liquefied natural gas product flow. In this instance, a larger plant is assumed generally in the range of 450 to 475 mtpd of liquified natural gas. The first pinion couples the bull gear to first recycle compression stage and the warm turbine and preferably absorbs between about 0.10 and 0.2 kw*hr per kg of liquified natural gas, and in the example depicted in Table 2A about 0.125 kw*hr per kg of liquified natural gas while the fourth pinion arrangement is dedicated to the natural gas service and absorbs between about 0.05 and 0.20 kw*hr per kg of liquified natural gas, and in the example depicted in Table 2A about 0.072 kw*hr per kg of liquified natural gas which is roughly half of the power adsorbed by the first pinion.

The remaining power from the integral gear 'bridge' machine is to be adsorbed by the second pinion and third pinion. The second pinion operatively couples the bull gear to the cold turbine and a first of two recycle split compression stages arranged in parallel while the third pinion operatively couples the bull gear to the second of two recycle split compression stages arranged in parallel. By splitting the second recycle compression stage into two split recycle compression stages arranged in parallel and on two different pinions, neither the second pinion or third pinion operate near the maximum fractional power limitations and constraints imposed by the integral gear 'bridge' machine. It should be noted that a serial splitting of the cold turbine pinion power is possible but is less advantageous than the configuration shown.

Table 2B compares the simulated performance of the baseline liquefied natural gas system and process generically depicted in FIG. 1A with the three-pinion, three-turbine arrangement shown in FIGS. 4A and 5A using the above-described arrangement of the turbines and compression states on the three pinions of the integral gear machine. As seen therein, the reduction in energy usage per metric tonne of liquefied natural gas produced in the embodiment depicted in FIG. 4A compared to the baseline configuration is 10.2% while the reduction in energy usage per metric tonne of liquefied natural gas produced in the embodiment depicted in FIG. 5A compared to the baseline configuration is 14.8% percent.

Similar to the embodiments described above with reference to FIGS. 2A and 3A, the embodiments of FIGS. 4A and 5A can also be effectively applied over a broad range of liquefied natural gas production rates from about 150 mtpd to over 1000 mtpd by simply changing the frame size of the integral gear 'bridge' machine and relative sizes of the associated turbomachinery. However, to spatially accommodate the four pinions, it would be advantageous to employ generally larger frame sizes suitable for larger production rates, for example, greater than 300 mtpd of liquified natural gas capacity.

The relative distribution of power across the four pinions will vary depending upon the pinion speed and the power limitations or constraints imposed by any particular frame size of the integral gear 'bridge' machine, with the approximate normalized range of total adsorbed power for each pinion shown in Table 2C. Again, similar to the earlier described example, the target pinion speed per unit of liquified natural gas mass flow will also vary to the reciprocal of liquified natural gas mass flow raised to roughly the 3/2 power.

TABLE 2A

| FIGS. 4B & 5B | Service #1 | Power (kw-hr/kg) | Service #2 | Power (kW-hr/kg) | Speed (rev/kg) | Net Power (kw-hr/kg) |
|---|---|---|---|---|---|---|
| Pinion #1 | N2 Comp #C1 | 0.258 | N2 Warm T1 | −0.133 | 70.6 | 0.125 |
| Pinion #2 | N2 Comp #C2A | 0.142 | N2 Cold T2 | 0.029 | 93.5 | 0.113 |
| Pinion #3 | N2 Comp #C2B | 0.113 | — | — | 114.5 | 0.113 |
| Pinion #4 | NG Comp #C3 | 0.115 | NG Warm T3 | −0.042 | 114.4 | 0.072 |

TABLE 2B

| Embodiment | Max N2 Pressure (bara) | Min N2 Pressure (bara) | NG Feed Pressure (bara) | NG Liquefaction Pressure (bara) | Power Usage kw-hr/mt | Δ Energy Usage (%) |
|---|---|---|---|---|---|---|
| FIG. 1 | 63.0 | 10.3 | 34.0 | 39.0 | 471 | Baseline |
| FIGS. 4A, 4B | 51.5 | 12.0 | 34.0 | 69.0 | 423 | −10.2% |
| FIGS. 5A, 5B | 60.7 | 14.8 | 34.0 | 69.0 | 401 | −14.9% |

TABLE 2C

| Approximate Range of Absorbed Total Pinion Power Consumption | | |
|---|---|---|
| Pinion | Minimum kw-hr/kg | Maximum kw-hr/kg |
| Pinion #1 (#C1-T1) Warm Turbine | 0.10 | 0.20 |
| Pinion #2 (#C2A-T2) Cold Turbine | 0.05 | 0.15 |
| Pinion #3 (#C3-T3) NG Expander | 0.05 | 0.20 |
| Pinion #4 (#C2B) | 0.05 | 0.15 |

LNG Production with 3-Pinion and 2 Turbine Integral Gear Machine

Figure 6A:
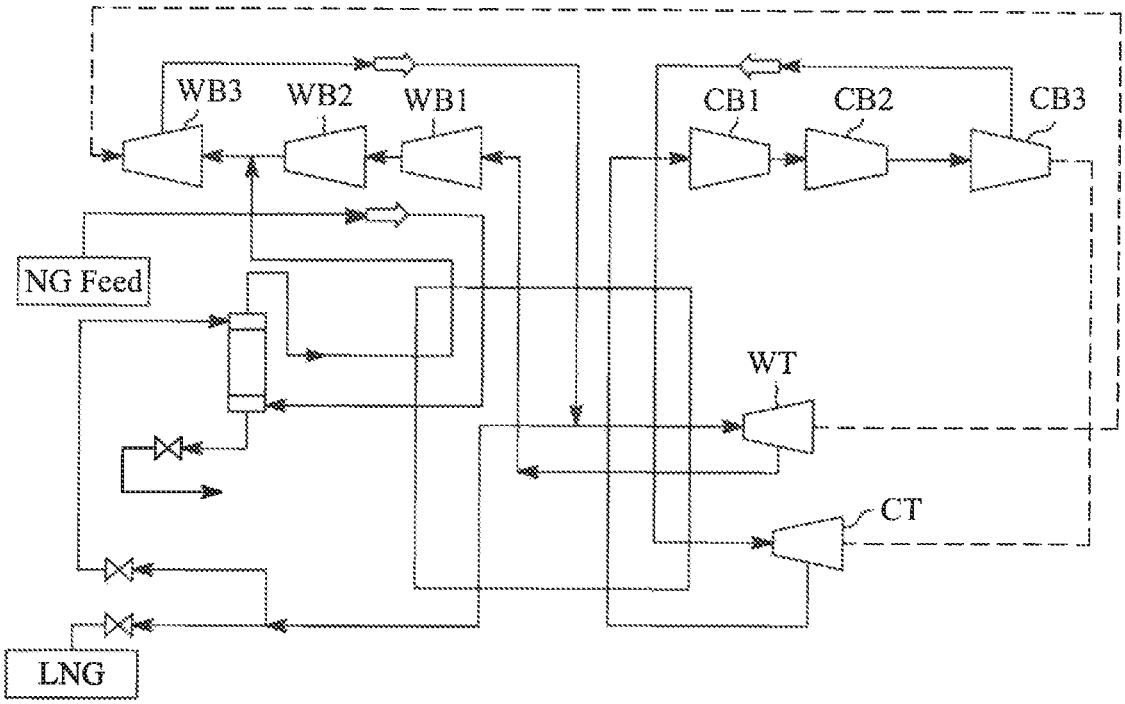
FIG. 6A shows a generalized schematic of the process flow diagram for the present system and method for liquefied natural gas production using two distinct refrigeration circuits and an integral gear machine with three pinions and including two turbines.

The process flow diagram depicted in FIG. 6A is in many regards similar to the process flow diagrams described above and for sake of brevity, much of the following discussion will focus on the differences in the process flow diagram depicted in FIG. 6A when compared to the process flow diagram depicted in FIG. 2A. The main differences can be seen in FIG. 6A and summarized as follows: (1) both natural gas compression and nitrogen-based refrigerant compression are done using a series of compression stages, with many of the compression stages operatively coupled to the integral gear machine via the three pinions, as detailed in FIG. 6B; (2) only a single warm turbine/expander that is a natural gas expander operatively coupled to one of the natural gas compression stages on one of the three pinions of the integral gear machine; and (3) the cold turbine/expander is configured to expand a cold portion of the nitrogen-based refrigerant, however, the cold turbine is further configured as a separate booster loaded turbine coupled to one of the nitrogen-based refrigerant compression stages and not integrated into the integral gear machine.

Figure 6B:
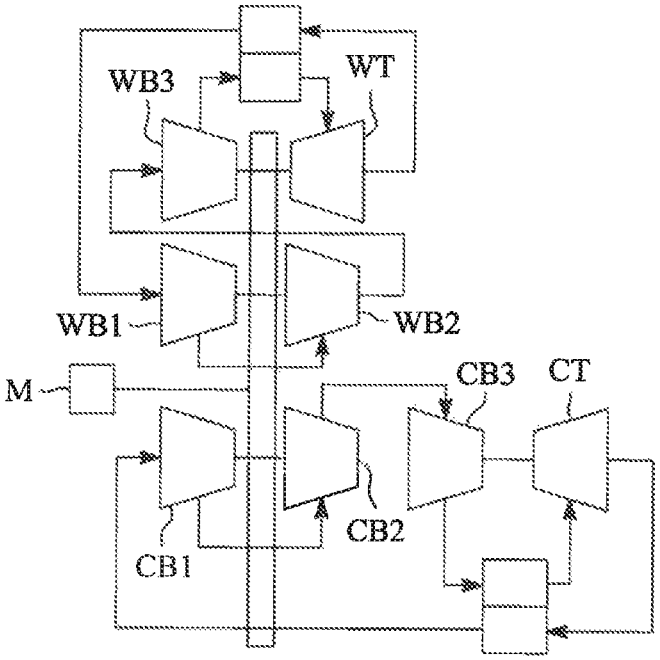
FIG. 6B shows a schematic illustration of the integral gear machine with three pinions of FIG. 6A depicting the optimized pairing of turbomachines.

Turning to the simplified depiction in FIG. 6B as well as Tables 3A and 3B, the integral gear machine is a 'bridge' type machine with a bull gear driven by motor is and a plurality of compression stages and turbines. The bull gear size in this example is again the medium size machine and includes three pinions. The first pinion arrangement couples the bull gear to first recycle compression stage. In this embodiment and example, the second pinion arrangement and third pinion arrangement are dedicated to the natural gas service. The second pinion arrangement couples the bull gear to the first natural gas compression stage and the second natural gas compression stage for a net power requirement which is near the maximum power limit for any pinion arrangement on the integral gear machine. The third pinion arrangement couples the bull gear to the third natural gas compression stage and the natural gas expansion. The cold turbine is a booster loaded turbine that drives the third recycle compression stage. Note that the warm turbine provides about 2.8 times the work than that of the cold turbine suggesting the warm turbine is again providing the largest refrigeration source. For sake of clarity, the reference labels in FIGS. 6A, 6B, 7A, and 7B are as follows: M=Motor; CT=Cold Turbine; WT=Warm Turbine; CB=Nitrogen Compression Stage(s) and WB=Natural Gas Compression Stage(s).

Tables 3A and 3B compare the simulated performance of the baseline or conventional liquefied natural gas system and process generically depicted in FIG. 1 with the three-pinion arrangement shown in FIG. 6A using an integral gear machine having a medium frame size. As seen therein, the energy usage per metric tonne of liquefied natural gas produced is about 13.8 percent lower.

TABLE 3A

| FIGS. 6A & 6B | Service #1 | Power (kw-hr/kg) | Service #2 | Power (kW-hr/kg) | Net Power (kw-hr/kg) |
|---|---|---|---|---|---|
| Pinion #1 | N2 Comp CB1 | 0.088 | N2 Comp CB2 | 0.088 | 0.175 |
| Pinion #2 | NG Comp WB1 | 0.115 | NG Comp WB2 | 0.115 | 0.231 |
| Pinion #3 | NG Comp WB3 | 0.212 | NGTurbine WT | −0.134 | 0.078 |
| Aux-Booster LoadedTurbine | N2 Comp CB3 | 0.048 | N2 Turbine CT | −0.048 | — |

TABLE 3B

| Embodiment | Max N2 Pressure (bara) | Min N2 Pressure (bara) | NG Feed Pressure (bara) | NG Liquefaction Pressure (bara) | IGM Power kw-hr/mt | Δ Energy Usage (%) |
|---|---|---|---|---|---|---|
| FIG. 1 | 63.0 | 10.3 | 34.0 | 39.0 | 471 | Baseline |
| FIGS. 6A | 87.0 | 12.0 | 34.0 | 60.0 | 406 | −13.8% |

LNG Production with 3-Pinion Integral Gear Machine and Separate NG Compression

Figure 7A:
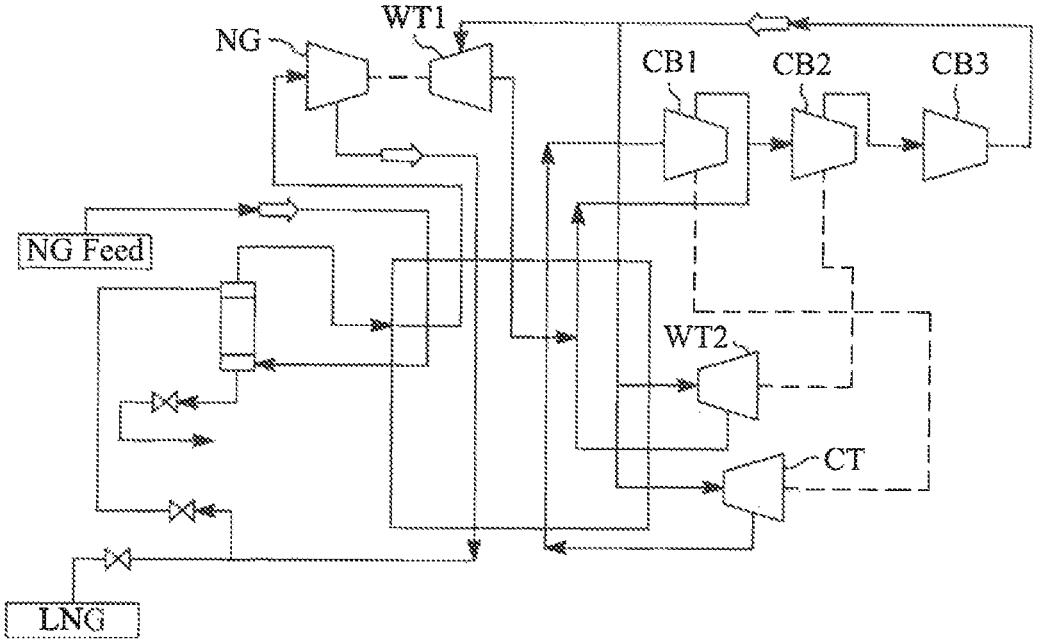
FIG. 7A shows a generalized schematic of the process flow diagram for the present system and method for liquefied natural gas production using two distinct refrigeration circuits and an integral gear machine with three pinions and a separate high speed, high efficiency booster loaded turbine driving a natural gas compression stage.

The process flow diagram depicted in FIG. 7A is in many regards similar to the process flow diagrams described above and for sake of brevity, much of the following discussion will focus on the differences in the process flow diagram depicted in FIG. 7A when compared to the process flow diagram depicted in FIG. 2A. The main differences can be seen in FIG. 7A and summarized as follows: (1) the nitrogen-based refrigerant compression are done using a series of compression stages, with all of the compression stages operatively coupled to the integral gear machine via the three pinions, as detailed in FIG. 7B; (2) there are two warm turbines/expanders with the first warm turbine/expander configured to expand a warm portion of the nitrogen-based refrigerant and operatively coupled to one of the nitrogen-based refrigerant recycle compression stages on one of the three pinions of the integral gear machine; and (3) the second warm turbine/expander is configured to expand another warm portion of the nitrogen-based refrigerant, however, the second warm turbine/expander is configured as a separate booster loaded turbine coupled to the natural gas compression stage and not integrated into the integral gear machine.

Figure 7B:
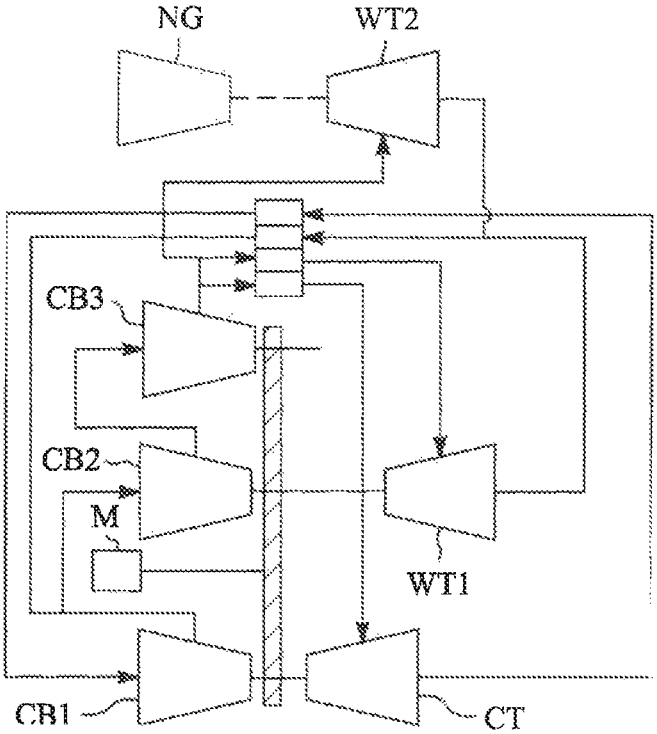
FIG. 7B shows a schematic illustration of the integral gear machine with three pinions of FIG. 7A depicting the optimized pairing of turbomachines.

Turning now to FIG. 7B as well as Tables 4A and 4B, the integral gear machine includes a bull gear driven by a motor and includes a plurality of compression stages and turbines/expanders coupled thereto. The bull gear size in this example is again a medium size and includes three pinions. The first pinion couples the bull gear to first recycle compression stage (CB1) and the cold turbine (CT) while the second pinion operatively couples the bull gear to the second recycle compression stage (CB2) and the warm turbine (WT2). In this embodiment, the third pinion arrangement operatively couples the bull gear to the third recycle compression stage (CB3). In this embodiment, the natural gas compression stage is driven by an auxiliary booster loaded warm turbine (WT1) and drives a natural gas compression stage (WB3).

Tables 4A and 4B also compares the simulated performance of the baseline or conventional liquefied natural gas system and process generically depicted in FIG. 1 with the three-pinion, three-turbine arrangement shown in FIG. 7A using an integral gear machine having a medium frame size. As seen therein, the energy usage per metric tonne of liquefied natural gas produced is about 11.7% lower but generally produces more liquefied natural gas product than the baseline system in a comparable frame size. It should be noted that the relative power savings associated with this embodiment, expressed as kw*hr per kg of liquified natural gas produced is partially offset by the additional capital costs associated with the high speed, booster loaded natural gas expander driving the natural gas compression stage.

TABLE 4A

| FIGS. 7A & 7B | Service #1 | Power (kw-hr/kg) | Service #2 | Power (kW-hr/kg) | Net Power (kw-hr/kg) |
|---|---|---|---|---|---|
| Pinion #1 | N2 Comp CB1 | 0.139 | N2 Cold CT | −0.054 | 0.085 |
| Pinion #2 | N2 Comp CB2 | 0.248 | N2 Warm WT1 | −0.127 | 0.120 |
| Pinion #3 | N2 Comp CB3 | 0.210 | — | — | 0.210 |
| Aux-BLT | NG Comp NG | 0.028 | Aux Warm WT2 | −0.028 | 0.000 |

TABLE 4B

| Embodiment | Max N2 Pressure (bara) | Min N2 Pressure (bara) | NG Feed Pressure (bara) | NG Liquefaction Pressure (bara) | IGM Power (kw-hr/mt) | Δ Energy Usage (%) |
|---|---|---|---|---|---|---|
| FIG. 1 | 63.0 | 10.3 | 34.0 | 39.0 | 471 | Baseline |
| FIGS. 7A | 80.8 | 10.7 | 34.0 | 64.0 | 416 | −11.7% |

INDUSTRIAL APPLICABILITY

Given the similarities of the integral gear machine configurations in the above-described embodiments, a possible strategy to reduce the capital costs for the present system and method involves standardizing a portion of the integral gear machine. For example, many of the embodiments can be modified to standardize the first and second pinion arrangements of integral gear machine while allowing customization of the third and optionally fourth pinion arrangements. By dedicating the first and second pinions of integral gear machine to adsorb the energy on each pinion required for the base refrigeration circuit, namely the nitrogen-based gas expansion refrigeration, one can design an LNG platform and potentially reduce the capital costs required for such solutions. Using the same LNG platform the design of the third (and optional fourth) pinion arrangements would be customizable to meet the natural gas refrigeration service requirements or auxiliary refrigeration requirements for any given application or customer. The third and fourth pinion arrangements would also accommodate other liquefaction process customizations, such as distributing compression power.

Such platform customizations would foreseeably be tailored to specific liquefaction applications, the quality (e.g. rich or lean) and pressure of the natural gas feed stream, the availability of auxiliary refrigerants, etc. As presently envisioned, the third and fourth pinion arrangements are preferably dedicated to natural gas compression and expansion and/or other warm level refrigeration (i.e. >−50° C.). Simply put, this LNG platform approach using a mixed service integral gear machine provides more design flexibility and more options for liquefied natural gas production, particularly for small to medium-scale liquefied natural gas production applications.

While the present invention has been described with reference to a preferred embodiment or embodiments, it is understood that numerous additions, changes and omissions can be made without departing from the spirit and scope of the present invention as set forth in the appended claims.

What is claimed is:

1. A natural gas liquefaction system, comprising:

a refrigeration circuit comprising: (i) three or more turbines/expanders configured to expand a refrigerant stream to produce exhaust streams that are directed to a heat exchanger; (ii) the heat exchanger configured to liquefy and subcool a compressed natural gas containing stream via indirect heat exchange with the exhaust streams from the three or more turbines/expanders; (iii) one or more refrigerant compression stages configured to recycle the warmed exhaust streams; and (iv) at least one natural gas compression stage configured to compress a natural gas containing feed to a pressure greater than the critical pressure of natural gas forming the compressed natural gas containing stream, wherein the natural gas compression stage is configured to be driven by one of the three or more turbines/expanders; and an integral gear machine comprising a drive assembly, a bull gear and at least three pinions arranged to drive the plurality of refrigerant compression stages and for receiving work produced by two of the three or more turbines/expanders, wherein each pinion of the at least three pinions is a net absorber of power from the drive assembly;

wherein one of the three or more turbines/expanders is not coupled to the integral gear machine and wherein the natural gas compression stage is driven by the one of the three or more turbines/expanders that is not coupled to the integral gear machine.

2. The natural gas liquefaction system of claim 1, wherein the natural gas containing feed is a methane containing biogas stream.

3. The natural gas liquefaction system of claim 1, wherein the natural gas compression stage is configured to further compress the natural gas feed to a pressure between about 50 bar (a) and 80 bar (a).

4. The natural gas liquefaction system of claim 1, wherein the three or more turbines/expanders include: (i) a first warm turbine configured to expand a first warm portion of a primary refrigerant stream and produce a first warm exhaust that is recycled to the one or more refrigerant compression stages; (ii) a cold turbine configured to expand a cold portion of a primary refrigerant stream and produce a cold exhaust that is recycled to the one or more refrigerant compression stages; and (iii) a second warm turbine configured to expand a second warm portion of a primary refrigerant stream and produce a second warm exhaust that is recycled to the one or more refrigerant compression stages.

5. The natural gas liquefaction system of claim 4, wherein: (i) the first warm turbine and one of primary refrigerant recycle compression stages are operatively coupled to the integral gear machine by the first pinion of the at least three pinions; (ii) the cold turbine and another one of primary refrigerant recycle compression stages are operatively coupled to the integral gear machine by the second pinion of the at least three pinions; and (iii) the second warm turbine is the one of the three or more turbines/expanders that is not coupled to the integral gear machine and is a high speed, booster loaded turbine operatively coupled to the natural gas compression stage.

6. The integral gear machine for natural gas liquefaction system of claim 1, wherein the driver assembly is an electric motor, a steam turbine, or a gas turbine.

* * * * *